US005704824A

United States Patent [19]

Hashish et al.

[11] Patent Number: 5,704,824

[45] Date of Patent: Jan. 6, 1998

[54] METHOD AND APPARATUS FOR ABRASIVE WATER JET MILLINS

[76] Inventors: Mohamad Hashish, 5117 165th Pl. SE., Bellevue, Wash. 98006-5500; David O. Monserud, 3026 NW. 70th, Seattle, Wash. 98117; Steven J. Craigen, 5526 S. 300th Pl., Auburn, Wash. 98001; Mark H. Marvin, 4018 N. 33rd, Tacoma, Wash. 98407; Paul H. Tacheron, 32920 206th Pl. SE., Auburn, Wash. 98092; David H. Bothell, 23113 S. Prairie Rd. E., Sauner, Wash. 98390; Ronald C. Lilley, 35615 6th Ave. SW.; Peter J. Miles, 952 SW. Campus Dr. #43-A1, both of Federal Way, Wash. 98023

[21] Appl. No.: 617,493

[22] Filed: Mar. 15, 1996

Related U.S. Application Data

[63] Continuation-in-part of Ser. No. 510,008, Aug. 1, 1995, abandoned, which is a continuation of Ser. No. 134,987, Oct. 12, 1993, abandoned.

[51] Int. Cl.[6] ..... B24B 1/00; B24C 1/00

[52] U.S. Cl. ..... 451/36; 451/41; 451/29

[58] Field of Search ..... 451/29, 30, 36, 451/38, 39, 41, 42, 87, 89, 80, 82

[56] References Cited

U.S. PATENT DOCUMENTS

| | | | |
|---|---|---|---|
| 315,472 | 4/1885 | Brown . | |
| 1,437,131 | 10/1922 | Correll . | |
| 1,720,568 | 7/1929 | Phillip . | |
| 1,720,569 | 7/1929 | Phillip . | |
| 2,092,083 | 9/1937 | Ogle et al. | 51/273 |
| 3,267,621 | 8/1966 | Meyers et al. | 51/312 |
| 3,328,925 | 7/1967 | Hewitt | 51/312 |
| 3,579,926 | 5/1971 | Gaspari | 451/30 |
| 3,640,163 | 2/1972 | Giardini et al. | 89/53 |
| 3,953,941 | 5/1976 | Kuhn et al. | 51/15 |
| 4,005,549 | 2/1977 | Perry . | |
| 4,272,612 | 6/1981 | Oliver | 430/323 |
| 4,300,318 | 11/1981 | Brown | 451/38 |
| 5,031,373 | 7/1991 | Montgomery | 451/36 |

OTHER PUBLICATIONS

Proceedings of the Fourth US Water Jet Conference Hashish Aug. 26, 1987 Milling with Abrasive Waterjets: A Preliminary Investigation.

9th International Symposium on Jet Cutting Technology, Hashish Oct. 6, 1988 Turning Milling and Drilling with Abrasive Waterjets.

Transactions of the ASME, Hashish, Jan. 5 189 An Investigating of Miling with Abrasive Waterjets.

Machining Characteristics of Advanced Materials Hashish, ASME Dec. 10, 1989.

Advanced Machining with Abrasive Waterjets Hashish, SME, May 1, 1990.

Applications of Precision AWJ Machining, Hashish Proceedings of the 6th Anual American Water Jet Conference Aug. 24, 1991.

*Primary Examiner*—James G. Smith
*Assistant Examiner*—Derris H. Banks
*Attorney, Agent, or Firm*—Don R. Mollick

[57] ABSTRACT

The invention describes a method and apparatus for milling objects by means of high velocity abrasive waterjet. The apparatus includes means for holding and producing relative motion in three dimensions of both the workpiece and the jet. Control means are provided to allow uniform and variable depth milling of complex shapes and automatic variations in relative speed, standoff distance, angle and pressure. The method includes the use of a resistant mask for facilitating milling and production of masks by the same tool used for milling.

19 Claims, 6 Drawing Sheets

METHOD AND APPARATUS FOR ABRASIVE WATER JET MILLINS

This application is a continuation-in-part of application Ser. No. 8/510,008, filed Aug. 1, 1995, now abandoned, which is a continuation of application Ser. No. 08/134,987 filed Oct. 12, 1993, now abandoned.

FIELD OF INVENTION

This invention pertains to the machining of materials. In particular this invention pertains to the machining of materials to predetermined shape by use of a jet of high velocity liquid with entrained abrasive particles.

BACKGROUND OF INVENTION

Materials have been machined by many methods in the past. Machining is defined as the process of shaping a material to a desired shape by cutting action. The machining processes were originally developed for wood then metals. Today machining is commonly used on such diverse materials as ceramics, plastics and composite materials in addition to the traditional materials. In the most common form of machining a solid piece of hard material such as tungsten carbide is held against a workpiece in relative motion. Common machine tools include drills, lathes, milling machines and grinders. The determination of the type of tool is dependent upon the relative movements of the parts and which part is moved and whether the part is rotated in movement. While milling is used throughout this application as a description of the process that term is not intended to limit the process defined to that of a traditional milling machine. For purposes of this application milling is defined to be a process where material is removed at a controlled rate and in controlled areas to shape a workpiece to a predetermined shape.

In conventional machining the shape of the article produced is largely determined by the type of tool used. For example lathes can only produce articles having a rotational axis of symmetry. In practice, the different machine tools are combined to produce a final article. A typical product may have been turned on a lathe, drilled with a drill press, and include ground or milled surfaces. Each time the tool is changed the workpiece must be dismounted. The designer of the finished part must carefully consider the machining process to allow the part to be made with minimal tool changes. Access for the cutters of each of the different tools must also be provided. Due to these design constraints many shapes are impossible to create by machining alone.

Waterjets are used to cut materials. A waterjet cutting system includes a source of high pressure fluid and a nozzle. The nozzle includes a pierced jewel or orifice and a housing to contain the orifice. The jet emerges from the orifice when high pressure liquid fills the housing. The jet is the actual cutting tool. Many ingenious mountings and systems of joints and seals connect the nozzle to a source of high pressure liquid. Waterjet cutting systems are routinely used to cut relatively soft materials to precise shapes. Precise cutting of sheet goods with minimal material wastage is a typical application.

Abrasive waterjets developed recently are increasingly used in manufacturing industries. An abrasive waterjet system entraps a finely divided abrasive material in a jet of high pressure liquid. First, a waterjet is created as in a waterjet cutting system. Abrasive material is supplied to the waterjet in a chamber. The waterjet with abrasive material is shaped and formed by a mixing tube before reaching the workpiece.

Abrasive waterjet systems are used in many industries. The primary use of abrasive waterjet systems is trimming parts created by other tools. Industries often view abrasive waterjets as a rough cutting tool only. This view is too limited. The abrasive water jet is of use as a precision machining tool for such applications as drilling, turning and milling. There is a current need to adapt the abrasive water jet to machining. The abrasive waterjet is theoretically able to machine wide varieties of materials. The difficulties encountered in the prior art have largely had to do with controlling this powerful tool.

BRIEF DESCRIPTION OF THE INVENTION

The invention provides a method and apparatus for milling of materials by use of abrasive waterjet. The discoveries herein recounted are adaptable to a wide variety of materials ranging from the hardest ceramics to soft foams. The invention provides methods to control the removal of material to fractions of thousands of an inch. The apparatus allows the machining of shapes from a single piece that would have required assembly of discrete parts under conventional machining methods.

The method involves the use of a single abrasive jet. A mask may be situated between the jet and workpiece. The jet is moved relative to the workpiece. This movement can be accomplished by either moving the workpiece in three dimensions relative to the jet or by moving the jet itself. One or two of the three directions may be rotational under this method. The method also contemplates varying the speed of such relative movement as well as cutting angle and force. Control of each of the above factors must be maintained to compensate for variation in any of the other factors. While the process has the same goal as conventional machining, removal of material, the process is not directly analogous to turning, milling and grinding.

The apparatus of the invention includes an abrasive cutting jet. The jet is provided with an appropriate supply of fluids and abrasive. The jet is attached to a manipulator which allows the direction of the jet to be moved in three dimensions. These dimensions may be the traditional cartesian coordinates in some applications. Other applications may demand that the jet be movable over a plane but have unrestricted rotational freedom. Finally the jet may be movable along a line segment and have two degrees of rotational freedom for yet a third class of applications. In any of the above three classes of apparatus movement of the workpiece can be substituted for movement of the jet. In addition, the apparatus provides for varying the cutting power of the jet during the milling operation. In addition to variation of position and strength of the jet the speed of relative motion is capable of continuous variation. The apparatus provides simultaneous control of all of these functions to provide accurate removal of material. In addition to the above parts the apparatus contemplates the use of a mask in at least some applications. The apparatus can be further adapted to cut this mask with the abrasive jet of the invention.

In summary, the method and apparatus allow the machining of a wide variety of materials into shapes not easily created by conventional machining methods. All machine tool functions may be combined in a single operation.

DETAILED DESCRIPTION OF THE FIGURES

Figure 1:
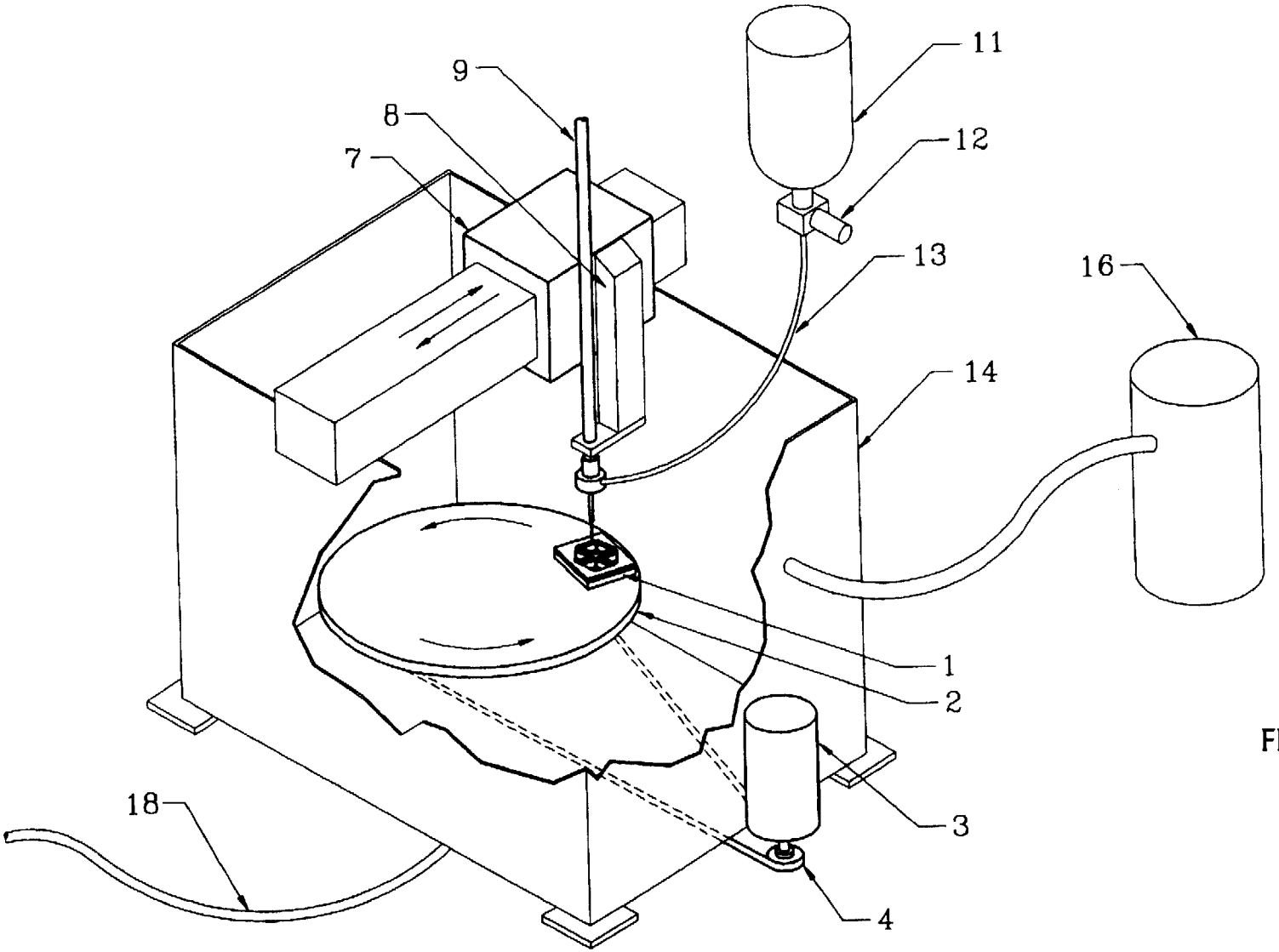
FIG. 1 is a perspective view of the apparatus of the invention.

FIG. 1 is a perspective view of the apparatus of the invention. This apparatus is particularly adapted to the milling of materials having a single axis of symmetry able to be rotated. Examples include disks, cylinders, cones and spheres. The apparatus illustrated is a test apparatus intended for testing the efficacy of the process on various materials. The components and parameters used are similar to commercial systems.

The workpiece 1 is attached to a platter 2. Platter 2 is adapted for rotation by a motor 3. Motor 3 rotates platter 2 through transmission 4. An abrasive waterjet 6 is located above the workpiece 1. Abrasive waterjet 6 is movable in the x or horizontal direction by traverse system 7. Abrasive waterjet 6 is also movable in the vertical direction or y by a second traverse system 8. In the apparatus shown abrasive waterjet 6 is, therefore, movable in the x and y direction. The work piece is movable along the axis of rotation of platter 2. The illustrated apparatus is thus roughly analogous to a lathe. Abrasive waterjet 6 is supplied with high pressure liquid through supply line 9. Abrasive is supplied from hopper 11 via metering/shutoff valve 12 and supply line 13. Components 1,2,4 and 6 are contained in a spoils collection tank 14 which serves to contain liquid, abrasive and spoils to prevent contamination of the work area. Spoils collection tank 14 is maintained at negative pressure by a vacuum system 16 connected to tank 14 by vacuum line 17. Vacuum system 16 removes air and moisture from tank 14. Spoils are removed by a separate pump (not shown) via spoils removal line 18. A waste type pump is used in this application.

To operate the apparatus of FIG. 1, a workpiece 1 is first attached to platter 2. A mask is positioned between workpiece 1 and abrasive jet 6. Preferably the mask should be no further than 0.1 inches away from workpiece 1. The mask is preferably cut out of a material which is harder than workpiece 1. For example if work piece 1 is aluminum the mask could be steel. Suitable materials for the mask include steel, cast iron, silicon and tungsten carbides and titanium. The harder materials will produce longer lasting masks. The mask includes holes where the machining is sought. The mask edges should be parallel to the cavity sought to be eroded. It has been found that the mask may be bonded to workpiece 1 by use of an adhesive such as epoxy. Surprisingly, The adhesive survives the jet impact and milling environment.

Motor 3 is started and rotation of platter 2 and workpiece 1 begun. High pressure fluid is then supplied to abrasive jet 6 via supply line 9 along with abrasive from hopper 11. Traverse system 7 sweeps abrasive jet 6 across the face of workpiece 1. In operation abrasive jet 6 erodes workpiece 1 at a faster rate than it erodes the mask. The process continues until workpiece 1 is milled to the desired depth or the mask is destroyed. When the desired degree of milling is approached the pressure supplied to abrasive jet 6 is decreased. It has been found that for example 20,000 psi is safe for an aluminum skin of 0.025 inch. The mask can be formed by the same apparatus used to do the milling.

Using the apparatus of FIG. 1 it has been found that the relative velocity of jet 6 relative to workpiece 1 is the most important factor for precision milling. The higher the relative velocity the less material is removed per pass and the higher the resolution of milling. For high resolution milling the tangential speed should be greater than 2000 inches/minute. Preferably, the speed should be greater than 8000 in./min. Speeds as high as 100,000 in./min. will produce even better results. The sweep rate should be selected such that jet 6 overlaps about 40% of the previous area of exposure. The overlap may be altered slightly during operation avoid tracking and the formation of "lay" marks. Satisfactory amounts of overlap vary between 40 and 80%. The tangential velocity will be greater on the outside of workpiece 1 than at the area closer to the center of rotation. Accordingly, to obtain a uniform depth pocket the rotational speed should be varied to obtain constant tangential velocity. Due to the high speeds involved this is preferably done by computer.

Control of the sweep rate seperatly or in combination with the rotational speed provides a second manner to alter the profile of the milled pocket. Alternatively, the stand off distance of abrasive jet 6 can be varied by manipulator 8 to control the rate of milling. this method can either be used to provide even cutting or compensate for alterations in tangential velocity due to workpiece 1's shape as described above.

After the milling process is completed it is desirable to shut valve 12 and cutoff the supply of abrasive to nozzle 6. Sweeping nozzle 6 with only water supplied then provides an excellent cleaning of the newly machined surface. This operation also removes any embedded abrasive particles.

Figure 2:
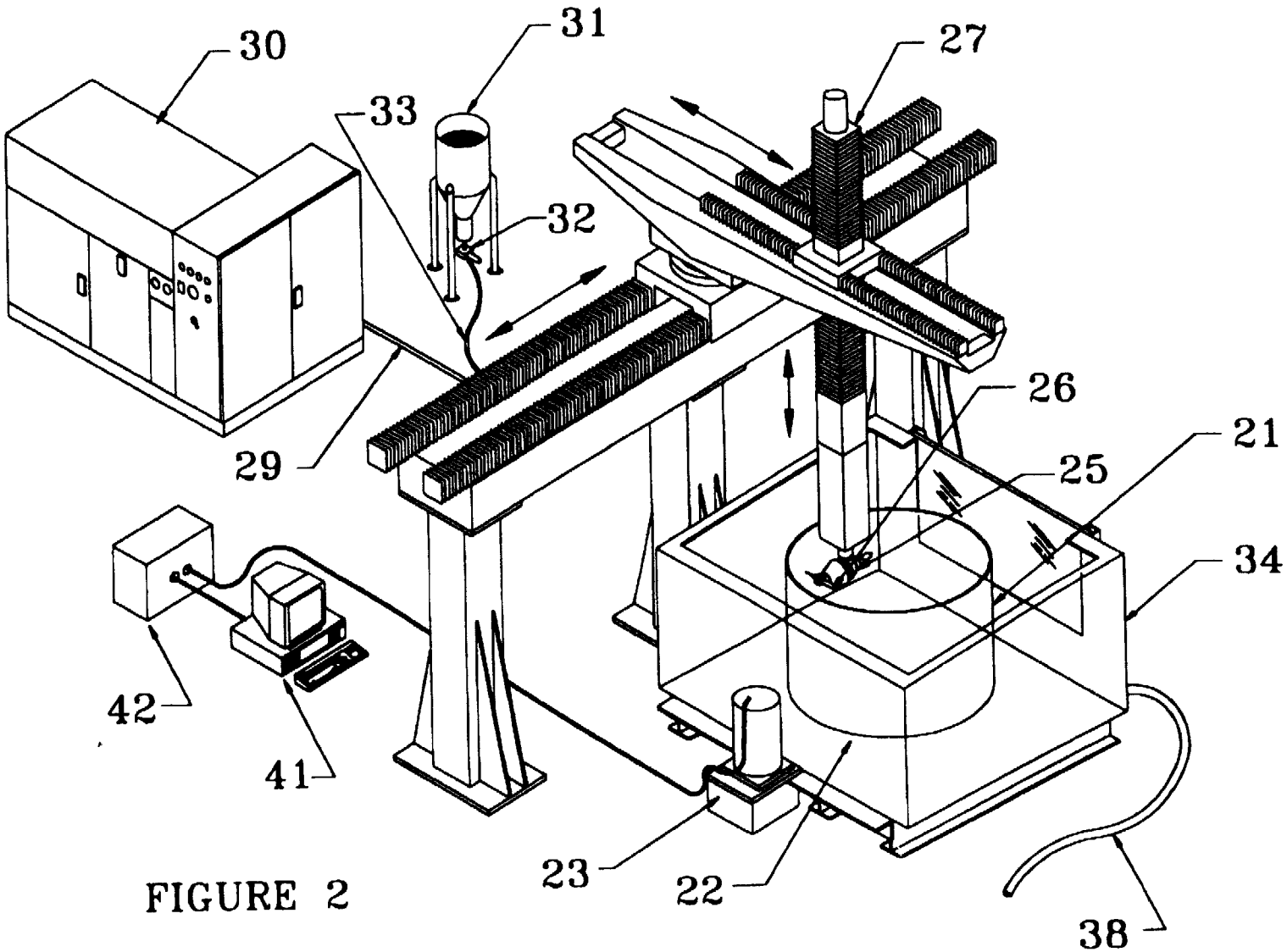
FIG. 2 is a perspective view of a second embodiment of the apparatus of the invention.

FIG. 2 is a perspective view of the apparatus of a second embodiment of the invention. This apparatus is particularly adapted to the milling of isogrid surfaces on materials having a single axis of symmetry able to be rotated. Examples include disks, cylinders, cones and spheres. The apparatus illustrated is a prototype milling center. The components and parameters used are similar to commercial systems, this apparatus introduces several additional means to control milling not present in the FIG. 1 apparatus.

The workpiece 21 is attached to a platter 22. In this illustration workpiece 21 is a cylinder. Platter 22 is adapted for rotation by a motor 23. An abrasive waterjet 26 is located above the workpiece 21. Abrasive waterjet 26 is movable in the x or horizontal direction by traverse system 27. Abrasive waterjet 26 is also movable in the vertical direction or y by a traverse system 27. Abrasive waterjet 26 is also movable in the horizontal direction or z by a traverse system 27. Traverse system 27 also called a x-y-z manipulator is a commercially available system which allows movement in all three Cartesian coordinates. In addition in this embodiment abrasive waterjet 26 is capable of movement around two perpendicular axes of rotation, this is accomplished by locating abrasive waterjet 26 on the wrist 25 of the vertical arm of manipulator 27. In the apparatus shown abrasive waterjet is, therefore, movable in all directions along either Cartesian or rotational coordinates. The work piece is movable along the axis of rotation of platter 22. The illustrated apparatus is thus roughly analogous to a lathe with the further capability of machining irregular surfaces in three dimensions. Abrasive waterjet 26 is supplied with high pressure liquid through supply line 29 from an ultra high pressure liquid pump 30. Abrasive is supplied from hopper 31 via metering/shutoff valve 32 and supply line 33. Components 21,22,25 and 26 are contained in a spoils collection tank 34 which serves to contain liquid, abrasive and spoils to prevent contamination of the work area. Spoils collection tank 34 is maintained at negative pressure by a vacuum system connected to tank 34 by a vacuum line. Spoils are removed by a separate pump (not shown) via spoils removal line 38. A flushing system provides an additional flow of fluid to aid in removal of waste. The operation of all components is controlled by a computer 41 interfacing through a system controller 42.

To operate the apparatus of Figure 2, a workpiece 21 is first attached to platter 22. In this embodiment an isogrid surface is being milled on the inner surface of a cylinder. A mask is positioned between workpiece 21 and abrasive jet 26. Preferably the mask should be no further than 0.1 inches away from workpiece 21. The mask is preferably cut out of a material which is harder than workpiece 21. For example if work piece 21 is aluminum the mask could be steel. Suitable materials for the mask include steel, cast iron, silicon and tungsten carbides and titanium. The harder materials will produce longer lasting masks. The mask includes openings where the machining is sought. The mask edges should be parallel to the cavity sought to be eroded. If for example the cavity is sought to have walls that are not normal to the surface of workpiece 21 it is preferable to angle the openings in the mask to the same degree. To mill around an entire area leaving a raised island the mask may be bonded to workpiece 21 by use of an adhesive such as epoxy. Surprisingly, The adhesive survives the jet impact and milling environment.

Motor 23 is started and rotation of platter 22 and workpiece 21 begun. High pressure fluid is then supplied to abrasive jet 26 via a supply line along with abrasive from hopper 31. Traverse system 27 sweeps abrasive jet 26 across the inner face of workpiece 21. In operation abrasive jet 26 erodes workpiece 21 at a faster rate than it erodes the mask. The process continues until workpiece 21 is milled to the desired depth before the mask is destroyed. When the desired degree of milling is approached the pressure supplied to abrasive jet 26 may be decreased if the thickness is small. It has been found that for example 20,000 psi is safe for an aluminum skin of 0.025 inch. The mask can be formed by the same apparatus used to do the milling.

Using the apparatus of FIG. 2 it has been found that the tangential velocity of jet 26 relative to workpiece 21 is the most important factor for precision milling. The higher the tangential velocity the less material is removed per pass and the higher the resolution of milling. For high resolution milling the tangential speed should be greater than 2000 inches/minute. Preferably, the speed should be greater than 8000 in./min. Speeds as high as 100,000 in./min. will produce even better results. The sweep rate should be selected such that jet 26 overlaps about 40% of the previous area of exposure. The overlap may be altered slightly during operation avoid tracking and the formation of "lay" marks. Satisfactory amounts of overlap vary between 40% and 80%.

Control of the sweep rate provides a manner to alter the profile of the milled pockets. In this manner the depth of the milling can be varied along the axis of rotation to the desired profile. Alternatively, the stand off distance of abrasive jet 26 can be varied by manipulator 27 to control the rate of milling. The angle of abrasive jet 26 to workpiece 21 can further control the speed of cutting. This angle can be set from 0–90% and may be continuously varied. This allow the cutting of inclined slots. The variance of this angle can also control the milling depth to a large degree.

After the milling process is completed it is desirable to shut valve 32 and cutoff the supply of abrasive to nozzle 26. Sweeping nozzle 26 with only water supplied then provides an excellent cleaning of the newly machined surface. This operation also removes any embedded abrasive particles.

Figure 3:
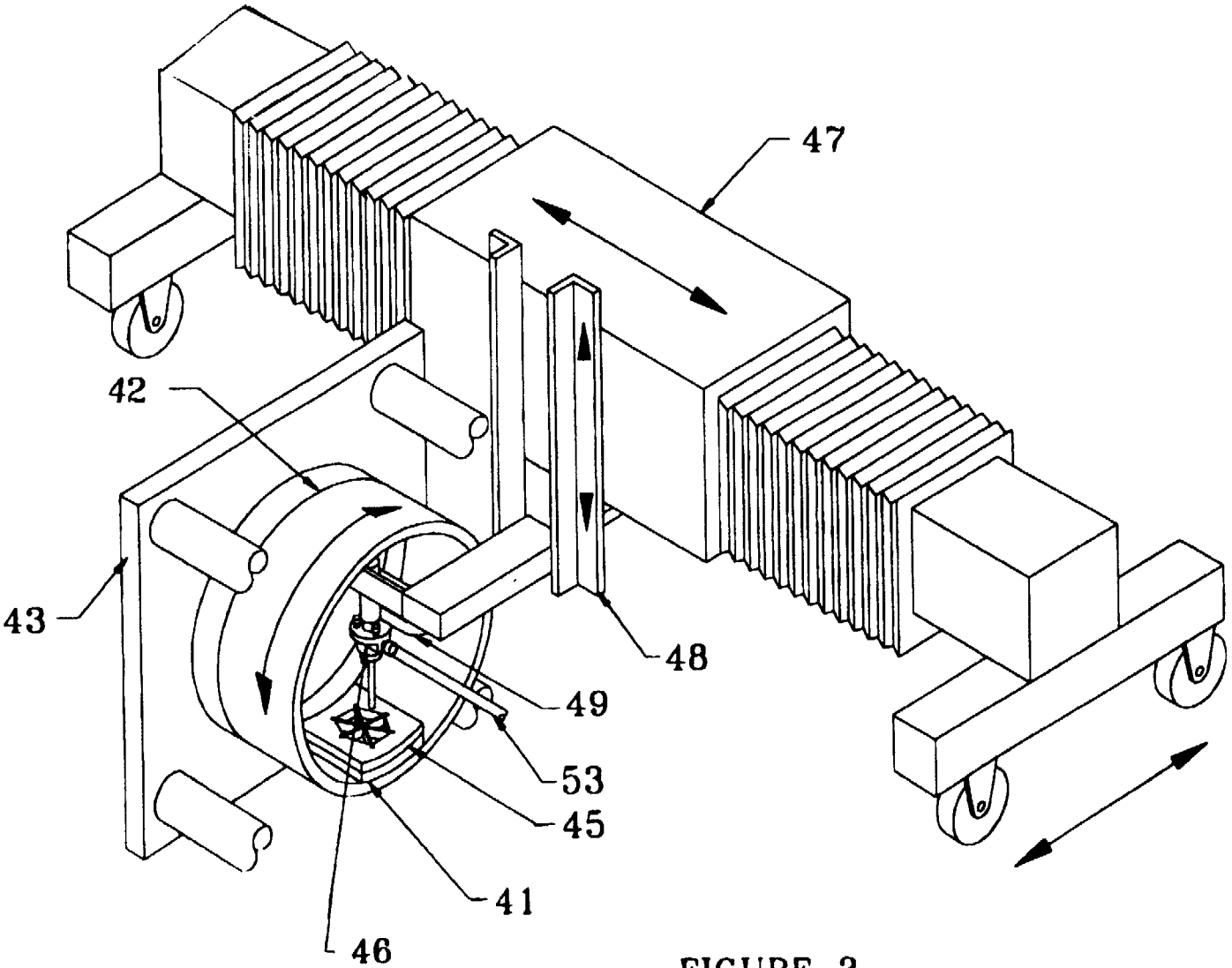
FIG. 3 is a perspective view of a third embodiment of the apparatus of the invention.

FIG. 3 is a perspective view of a third embodiment of the apparatus of the invention. This apparatus is particularly adapted to the milling of materials having a single axis of symmetry able to be rotated. Examples include cylinders, cones, spheres and sections thereof.

The workpiece 41 is attached to a rotatable drum 42. Drum 42 is adapted for rotation by a motor (not shown) and rotatably attached to a stationary frame 43. An abrasive waterjet 46 is located above workpiece 41. A mask 45 is situated between abrasive waterjet 46 and workpiece 41. Abrasive waterjet 46 is movable in the x or horizontal direction by traverse system 47. Abrasive waterjet 46 is also movable in the vertical direction or y by a second traverse system 48. In the apparatus shown abrasive waterjet 46 is, therefore, movable in the x and y direction. The work piece is movable along the axis of rotation of drum 42. The illustrated apparatus is thus roughly analogous to a lathe set for internal or external milling. Abrasive waterjet 46 is supplied with high pressure liquid through supply line 49. Abrasive is supplied from a hopper (not shown) via supply line 53.

To operate the apparatus of FIG. 3, workpiece 41 is first attached to drum 42. Mask 45 is positioned between workpiece 41 and abrasive jet 46. Preferably mask 45 should be no further than 0.1 inches away from workpiece 41. Mask 45 is preferably cut out of a material which is harder than workpiece 41. For example if work piece 41 is aluminum mask 45 could be steel. Suitable materials for mask 45 include steel, cast iron, silicon and tungsten carbides and titanium. The harder materials will produce longer lasting masks. Mask 45 includes holes where the machining is sought. The mask edges should be parallel to the cavity sought to be eroded. It has been found that mask 45 may be bonded to workpiece 41 by use of an adhesive such as epoxy. Surprisingly, The adhesive survives the jet impact and milling environment.

Drum 43 is started and rotation of workpiece 41 and mask 45 begun. High pressure fluid is then supplied to abrasive jet 46 via supply line 49 along with abrasive via line 51. Traverse systems 7 and 8 sweeps abrasive jet 46 across the face of mask 45. In operation abrasive jet 46 erodes workpiece 41 at a faster rate than it erodes mask 45. The process continues until workpiece 41 is milled to the desired depth or mask 45 is destroyed. When the desired degree of milling is approached the pressure supplied to abrasive jet 46 is decreased. It has been found that for example 20,000 psi is safe for an aluminum skin of 0.025 inch. Mask 45 can be formed by the same apparatus used to do the milling in the same manner as milling.

Using the apparatus of FIG. 3 it has been found that the tangential velocity of jet 46 relative to workpiece 41 is the most important factor for precision milling. The higher the tangential velocity the less material is removed per pass and the higher the resolution of milling. For high resolution milling the tangential speed should be greater than 2000 inches/minute. Preferably, the speed should be greater than 8000 in./min. Speeds as high as 100,000 in./min. will produce even better results. The sweep rate should be selected such that jet 46 overlaps about 40% of the previous area of exposure. The overlap may be altered slightly during operation avoid tracking and the formation of "lay" marks. Satisfactory amounts of overlap vary between 40 and 80%.

Control of the sweep rate provides a manner to alter the depth profile of the milled pocket. Alternatively, the stand off distance of abrasive jet 46 can be varied by manipulator 48 to control the rate of cutting.

After the milling process is completed it is desirable to cutoff the supply of abrasive to nozzle 46. Sweeping nozzle 46 with only water supplied across the surface of workpiece 41 and mask 45 provides an excellent cleaning of the newly machined surface. This operation also removes any embedded abrasive particles.

Figure 4:
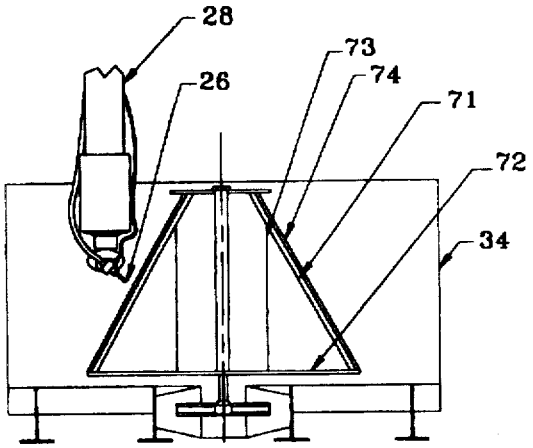
FIG. 4 is a front elevation section view of the FIG. 2 embodiment used to mill an external cone.

FIG. 4 is a front elevation section view of the FIG. 2 embodiment used to mill an external cone. In this case a cone shaped workpiece 71 is attached to a turntable 72 mounted in tank 34. A fixture 73 provides additional support. A mask 74 is positioned between workpiece 71 and abrasive jet 26. Manipulator 28 moves abrasive jet 26 across the external surface of workpiece 71 in the manner described above.

Figure 5:
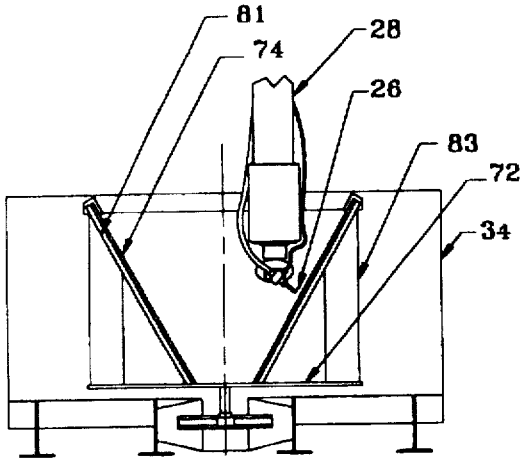
FIG. 5 is a front elevation section view of the FIG. 2 embodiment used to mill an internal cone.

FIG. 5 is a front elevation section view of the FIG. 2 embodiment used to mill an internal cone. In this case a cone shaped workpiece 81 is attached to a turntable 72 mounted in tank 34. A fixture 83 provides additional support. A mask 84 is positioned between workpiece 81 and abrasive jet 26. Manipulator 28 moves abrasive jet 26 across the internal surface of workpiece 81 in the manner described above.

Figure 6:
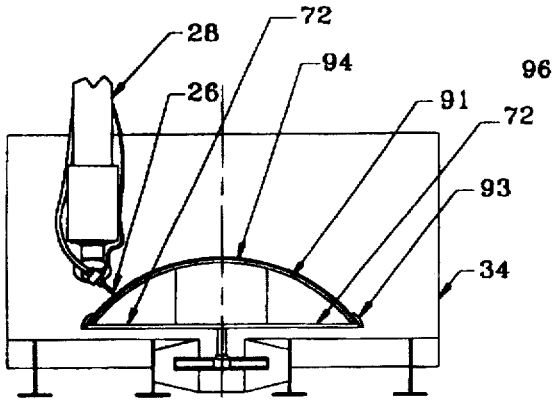
FIG. 6 is a front elevation section view of the FIG. 2 embodiment used to mill an external sphere.

FIG. 6 is a front elevation section view of the FIG. 2 embodiment used to mill an external sphere. In this case a sphere shaped workpiece 91 is attached to a turntable 72 mounted in tank 34. A fixture 93 provides additional support. A mask 94 is positioned between workpiece 91 and abrasive jet 26. Manipulator 28 moves abrasive jet 26 across the external surface of workpiece 91 in the manner described above. The abrasive jet nozzle should be maintained normal to to the workpiece.

Figure 7:
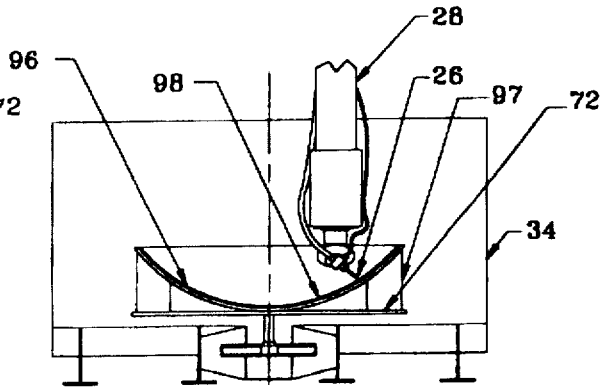
FIG. 7 is a front elevation section view of the FIG. 2 embodiment used to mill an external sphere.

FIG. 7 is a front elevation section view of the FIG. 2 embodiment used to mill an internal sphere. In this case a sphere shaped workpiece 96 is attached to a turntable 72 mounted in tank 34. A fixture 97 provides additional support. A mask 98 is positioned between workpiece 96 and abrasive jet 26. Manipulator 28 moves abrasive jet 26 across the internal surface of workpiece 96 in the manner described above. The angle of abrasive jet 26 relative to the workpiece 96 is similarly maintained.

Figure 8:
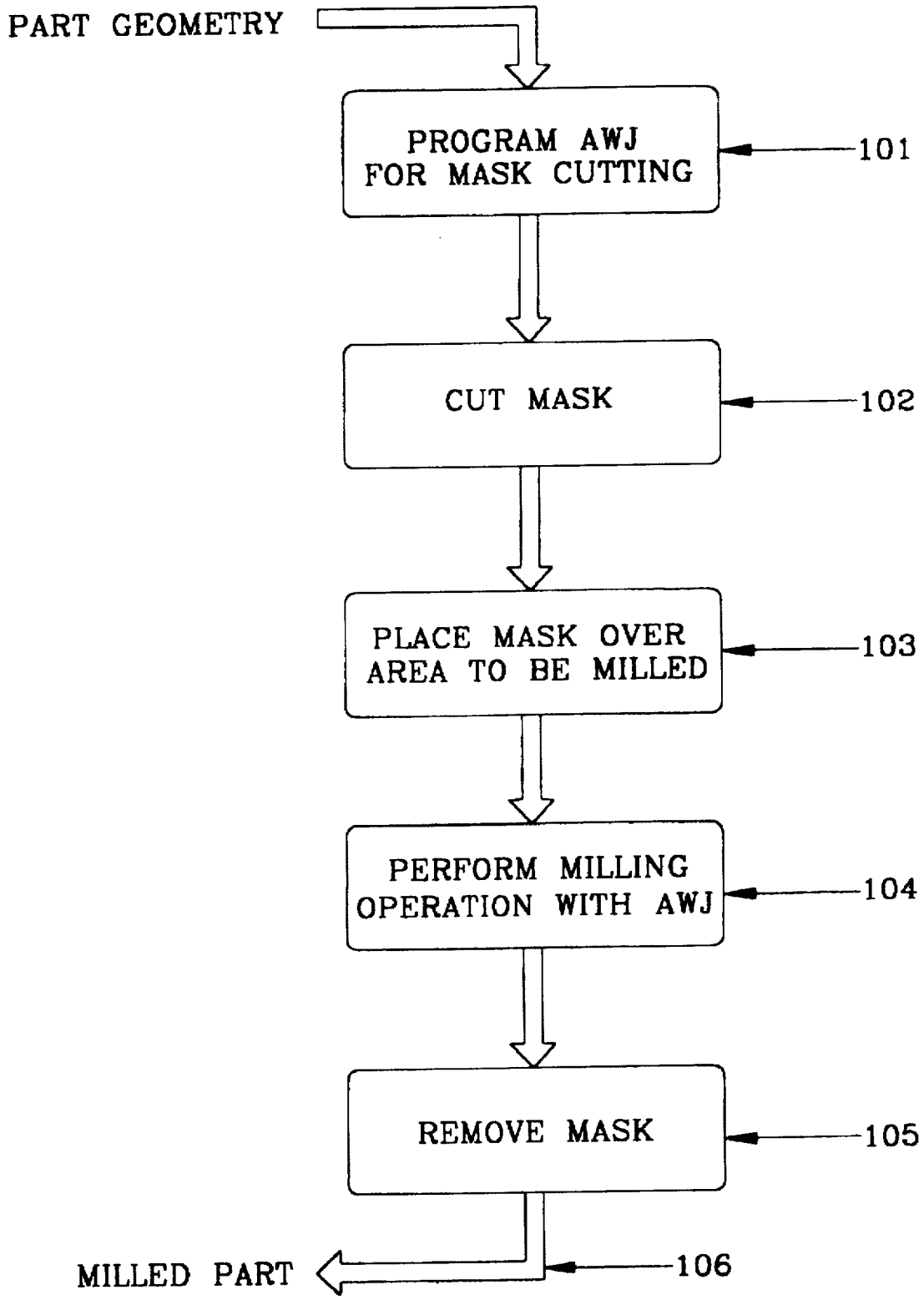
FIG. 8 is a flow chart of the process of the invention.

FIG. 8 is a flow chart of the process of the invention. First the geometry of the desired part is determined. This process is considerably simplified over conventional milling because a much wider degree of shapes may be milled. At this point a junction in the process occurs regarding the use of the process to form the mask. If desired the mask could be directly produced by casting or some other process. In this description we will assume the same apparatus used to mill the part will be used to cut the mask. The abrasive waterjet manipulator and apparatus is now programmed for mask cutting 101. The mask material is selected based upon the material of the workpiece selected according to the above design criterion. Next the abrasive waterjet cuts the mask 102. The workpiece is next mounted in a milling station and the mask is placed over the area to be milled 103. If the mask is formed by a separate operation this is the beginning of the process. Optionally the mask may be attached to the workpiece with adhesive. The milling operation is next preformed 104 with the abrasive waterjet. This operation includes the operations of programming abrasive waterjet motion, programming workpiece motion and applying fluids and abrasive to the apparatus as required. The next step is removal of the mask 105. After the mask is removed the milled part may optional be cleaned by the waterjet without abrasive if so desired. In either case the process ends with removal of the finished milled part 106.

Figure 10:
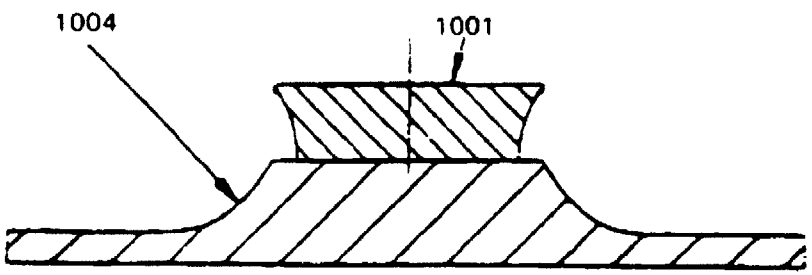
FIG. 10 is a section elevation vieew of FIG. 9 after milling.
Figure 9:
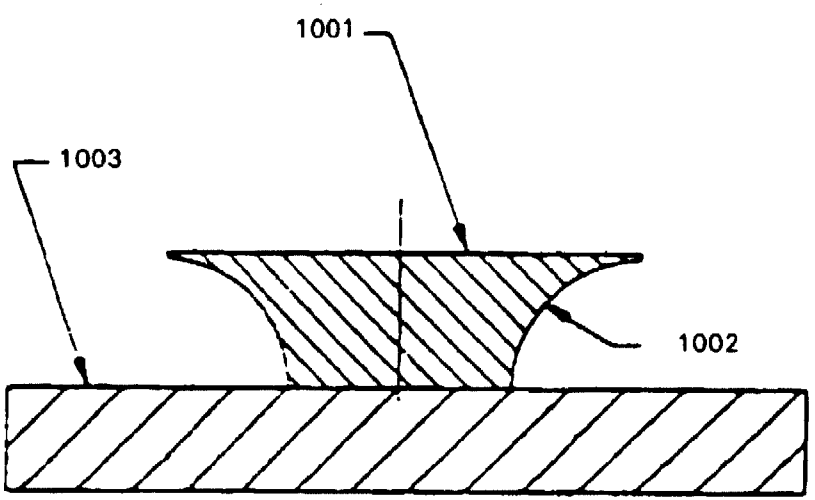
FIG. 9 is a section elevation view of a mask with radiated edges attached to a workpiece.

A method of creating radiased bosses is by use of eroding masks is illustrated in FIG. 9. Here a circular mask 1001 having a radius 1002 is attached to a workpiece 1003. When milling with a 4 inch long 0.070 inch diameter mixing tube abrasive waterjet with a 0.018 inch jewel with 80 mesh abrasives flowing at 1.25 lb/min. water pressure of 55 ksi and tangental and traverse velocities of 18,000 and 8.4 in/min. After milling in this manner mask 1001 and workpiece 1002 assume the shapes shown in FIG. 10. Mask 1001 erodes during use attenuating millinig in the area where a boss is desired. The result is the milling of a radiated boss 1004 onto the surface of workpiece 1002. It has been found in tests that a radias of 0.6 R produce a minimium of either under or overcutting.

We claim:

1. A milling machine for removing material from a workpiece in predetermined areas for producing a finished part comprising:

a framework for holding all pans of the machine; and, an abrasive waterjet cutting nozzle capable of being inclined at an angle between 0 and 90 degrees to the surface of said workpiece sought to be milled being milled for milling inclined pockets attached to said framework for generating a jet of rapidly moving liquid with entrained abrasive particles; and, a source of high pressure liquid attached to said abrasive waterjet curing nozzle; and a source of abrasive connected to said nozzle; and; workpiece mounting means for mounting a workpiece to said framework including means for moving said work piece relative to said nozzle; and traverse means attached to said framework and said nozzle for moving said nozzle relative to the surface of said workpiece wherein said milling machine is includes means for decreasing the rate of material removal when said nozzle is adjacent to an area of smaller radius.

2. A milling machine as in claim 1, wherein said milling machine for milling cylinders by having means for rotating the workpiece and moving the nozzle along a single line.

3. A milling machine as in claim 2, wherein said relative motion is accomplished by rotating said workpiece.

4. A milling machine as in claim 3, wherein said relative motion is accomplished by moving said abrasive jet.

5. A milling machine 3 wherein said abrasive jet is kept at an angle normal to the surface of said workpiece.

6. A milling machine as in claim 1, wherein said milling machine for milling spherical sections by having means for rotating the workpiece for obtainong speed for pocket milling depth control and moving the nozzle along three dimensions.

7. A milling machine as in claim 1, wherein said decrease in rate is accomplished by increasing the rate of rotation of said workpiece relative to said nozzle.

8. A milling machine as in claim 1, wherein said decrease in rate is accomplished by increasing the distance between said nozzle and the workpiece.

9. A milling machine as in claim 1, wherein the rate of rotation of said workpiece is varied to control workpiece surface speed as said nozzle changes radial position.

10. A milling machine as in claim 1, wherein said nozzle for cleaning the surface of said workpiece after milling and removing any imbedded particles.

11. A milling machine as in claim 1 wherein said abrasive jet is in motion relative to said workpiece at a speed greater than 2000 inches per minute.

12. A milling machine as in claim 1, wherein said machine is further comprising mask mounting means for mounting a mask between said nozzle and said workpiece.

13. An abrasive water jet milling tool for removing material from a workpiece as in claim 1, wherein the pressure of the liquid supplied to said nozzle is reduced as milling proceeds for preventing distortion of thin skins on the workpiece.

14. An abrasive water jet milling tool for removing material from a workpiece as in claim 1, wherein the standoff of said jet to said workpiece is continuously varied during operation of the tool for controlling the depth of milling.

15. An abrasive water jet milling tool for removing material from a workpiece as in claim 1, wherein the standoff of said nozzle is increased as milling proceeds for preventing distortion of thin skins on the workpiece.

16. A milling machine for removing material from a workpiece in predetermined areas for producing a finished part comprising:

a framework for holding all parts of the machine; and, an abrasive waterjet curing nozzle capable of being inclined at an angle between 0 and 90 degrees to the surface of said workpiece sought to be milled being milled for milling inclined pockets attached to said framework for generating a jet of rapidly moving liquid with entrained abrasive particles; and, a source of high pressure liquid attached to said abrasive waterjet cutting nozzle; and a source of abrasive connected to said nozzle; and; workpiece mounting means for mounting a workpiece to said framework including means for moving said work piece relative to said nozzle; and traverse means attached to said framework and said nozzle for moving said nozzle relative to the surface of said workpiece and a mask mounting means for mounting a mask between said nozzle and said workpiece less than 0.1 inches from the surface of the workpiece.

17. A milling machine as in claim 16, wherein the mask is to be bonded to said workpiece by an adhesive.

18. A milling machine as in claim 16, where in said mask is provided with a radius for producing a boss on said workpiece.

19. A milling machine as in claim 18, wherein said radius is about 0.6 R.

* * * * *